US006037921A

United States Patent [19]

Matsumoto et al.

[11] Patent Number: 6,037,921

[45] Date of Patent: Mar. 14, 2000

[54] DISPLAY CONTROL APPARATUS WITH INDEPENDENT INFORMATION RECEIVERS

[75] Inventors: Yuichi Matsumoto, Tokyo; Takashi Tsunoda; Hideo Kanno, both of Yokohama; Katsuhiro Miyamoto, Isehara, all of Japan

[73] Assignee: Canon Kabushiki Kaisha, Tokyo, Japan

[21] Appl. No.: 08/412,216

[22] Filed: Mar. 27, 1995

Related U.S. Application Data

[63] Continuation of application No. 08/062,337, May 17, 1993, abandoned.

[30] Foreign Application Priority Data

May 19, 1992 [JP] Japan ..... 4-126148

[51] Int. Cl.[7] ..... G09G 3/36

[52] U.S. Cl. ..... 345/88; 345/3

[58] Field of Search ..... 340/701, 703, 340/793, 784; 358/75, 76, 78, 80; 101/DIG. 2; 348/660, 661, 734; 345/88, 153, 154, 155, 150, 186, 1, 3, 97, 104

[56] References Cited

U.S. PATENT DOCUMENTS

| | | | |
|---|---|---|---|
| 4,496,968 | 1/1985 | Pugsley | 358/531 |
| 4,694,286 | 9/1987 | Bergstedt | 345/146 |
| 4,757,441 | 7/1988 | Buckland et al. | 345/2 |
| 4,789,854 | 12/1988 | Ishii . | |
| 4,795,239 | 1/1989 | Yamashita et al. . | |
| 4,902,107 | 2/1990 | Tsuboyama et al. . | |
| 4,923,285 | 5/1990 | Ogino et al. | 350/331 T |
| 4,962,376 | 10/1990 | Inoue et al. . | |
| 5,003,299 | 3/1991 | Batson et al. . | |
| 5,051,929 | 9/1991 | Tutt et al. | 345/150 |
| 5,060,055 | 10/1991 | Kim . | |
| 5,066,945 | 11/1991 | Kanno et al. . | |
| 5,124,688 | 6/1992 | Rumbal . | |
| 5,155,478 | 10/1992 | Sekiya et al. . | |
| 5,253,340 | 10/1993 | Inoue | 345/1 |
| 5,307,055 | 4/1994 | Baskin et al. | 348/734 |

FOREIGN PATENT DOCUMENTS

| | | |
|---|---|---|
| 0385449 | 9/1990 | European Pat. Off. . |
| 0438093 | 7/1991 | European Pat. Off. . |
| 2534052 | 4/1984 | France . |
| 61-94023 | 12/1986 | Japan . |

*Primary Examiner*—Chanh Nguyen

*Attorney, Agent, or Firm*—Fitzpatrick, Cella, Harper & Scinto

[57] ABSTRACT

Color conversion processing is enabled in accordance with the color characteristics of the display panel. A display control device displays images using a display panel with one picture element consisting of four pixels of red (R), green (G), blue (B) and white (I). A color converter generates R, G, B, I signals from an input signal, and a color characteristic discrimination signal changes the characteristics of the color converter.

14 Claims, 4 Drawing Sheets

$V=0$ $V < V_{th}$ $V_{th} < V < V_{sat}$ $V_{sat} < V$

DISPLAY CONTROL APPARATUS WITH INDEPENDENT INFORMATION RECEIVERS

This application is a continuation of application Ser. No. 08/062,337, filed May 17, 1993, now abandoned.

BACKGROUND OF THE INVENTION

1. Field of the Invention

The present invention relates to a display control apparatus for a display panel with one picture element constituted of four pixels of, for example, R (red), G (green), B (blue) and I (white), wherein the display control apparatus generates R, G, B and I signals from an input signal.

2. Related Background Art

Recently, display systems on the computer have been put to practical use, wherein display contents are represented not only by characters or lines but also natural images with characters and lines synthesized. This means that the feature of halftone display is important for the display panel (CRT, liquid crystal, plasma, EL) which is the display means in the display system. However, in display apparatuses except for CRT, the halftone display is not a simple matter. In the following, the halftone display on a liquid crystal display, particularly with a ferroelectric liquid crystal display panel will be exemplified.

Conventionally, display elements using a ferroelectric liquid crystal (FLC) are well known, wherein ferroelectric liquid crystal is injected into a liquid crystal cell having two sheets of glass substrate disposed opposedly with a cell gap of about 1 to 3 $\mu$m held, its opposed faces being formed with transparent electrodes and subjected to orientation treatment, as disclosed in Japanese Patent Application Laid-Open No. 61-94023.

The features of such a display element using ferroelectric liquid crystal include the fact that a bonding strength between an external electric field and spontaneous polarization can be used for switching, and that the switching can be effected with the polarity of the external electric field, as the longitudinal directions of ferroelectric liquid crystal molecules corresponds one-to-one to the spontaneous polarization directions thereof. The ferroelectric liquid crystal is utilized mainly for the binary (white, black) display elements by making two stable states of light transparent and interrupting.

Further, typically, color display apparatus are well known wherein color filters of red (R), green (G) and blue (B) corresponding to the size of an electrode are provided on the glass substrate, one picture element being constituted of three pixels of R, G and B. Also, in order to improve the color characteristic of a panel, by providing two G pixels, one picture element may be constituted of four pixels of R, G, B and I. Further, in order to compensate for decreased brightness of the panel which may be caused by the low light transmittance of color filter and liquid crystal itself, a color display apparatus has been proposed in U.S. patent application Ser. No. 968,402 (filing date Oct. 29, 1992) wherein, by providing a white (I) pixel by means of a white color filter, one picture element is constituted of four pixels of R, G, B and I. This I pixel acts to increase the number of display colors.

FIG. 2 shows the relationship between the switching pulse amplitude of a ferroelectric liquid crystal element and the transmittance. This is a graphic representation in which the quantity of transmitted light after applying a single pulse with one polarity to a cell (element) in a complete light interrupted state (black) is plotted as the function of the amplitude V of a single pulse. When the pulse amplitude is equal to or less than a threshold $V_{th}$ ($V<V_{th}$), no quantity of transmitted light will arise, in which the transparent state of the pixel after applying the pulse as shown in FIG. 3B is not different from that of FIG. 3A indicating a state before applying the pulse. If the pulse amplitude V exceeds the threshold ($V_{th}<V<V_{sat}$), a part of the pixel transfers to the other stable state, resulting in a light transparent state as shown in FIG. 3C indicating a halftone of transmitted light as a whole. If the pulse amplitude V is further increased, exceeding a saturation value $V_{sat}$ ($V_{sat}<V$), the whole pixel is placed in a light transparent state as shown in FIG. 3D, with the quantity of transmitted light being fixed.

As can be seen from FIG. 2 to FIG. 3D, it is requisite that the pulse amplitude V be controlled to be $V_{th}<V<V_{sat}$ in order to effect halftone display in the ferroelectric liquid crystal element. However, owing to a steep slope in a range from $V_{th}$ to $V_{sat}$, it is difficult to control the halftone correctly with the pulse amplitude V.

This problem has been described in connection with FLC, but the same thing can be said if more halftone levels are to be obtained for a TN liquid crystal having no active elements.

In order to resolve the above problem, a method has been proposed in which pseudo-halftone display is enabled by using only two states as shown in FIGS. 3B and 3D. At present, most color display systems are constituted by CRT as the display apparatus, but when they are constituted by FLC which is difficult to make halftone display, instead of CRT, a pseudo-halftone display function, as previously mentioned, may be provided within the display apparatus for the purpose of providing the compatibility with the CRT and the general utilization as the display system, as described in U.S. patent application Ser. No. 968,402, cited previously.

However, the color characteristic of a panel as display means may greatly change by the area ratios of pixels such as R, G, B and I, the wavelength of backlight or its distribution, but as the display means itself outputs no information concerning the color characteristic to the outside, it was necessary to change the digital processing for pseudo-halftone display depending on the panel to prevent the color tint of an image from varying when the display means was changed.

Also, depending on the display panel such as FLC in particular, the display characteristic, particularly the color characteristic sometimes changed with the change in temperature caused by the use.

Further, the display characteristic changed with the filter arrangement or dot density of the display panel.

SUMMARY OF THE INVENTION

The present invention has been achieved in the light of the above-described problem, and its object is to provide a display controller which can generate display data in accordance with the condition of display means.

To accomplish such object, according to the present invention, there is disclosed an apparatus for controlling display means comprising, receiving means for receiving information relating to a condition of the display means, generating means for generating image data in accordance with the condition of the display means received by said receiving means, and supplying means for supplying the image data generated by said generating means to the display means as display data.

Also, it is another object of the present invention to provide a display control device which can make the color conversion processing in accordance with the color characteristic of the display panel.

To accomplish such object, according to the present invention, there is disclosed an apparatus for controlling display means comprising, input means for inputting first color image data, converting means for converting the color image data into second color image data, supplying means for supplying the second color image data to the display means as display data, and setting means for setting the color converting characteristic of said converting means suitable for the display means.

Further, it is another object of the present invention to provide a display system excellent in color reproducibility.

It is still another object of the present invention to provide excellent reproduction of halftone images.

Other objects and forms of the present invention will be apparent from the following description based on the drawings, and the appended claims.

DETAILED DESCRIPTION OF THE PREFERRED EMBODIMENTS

Figure 1:
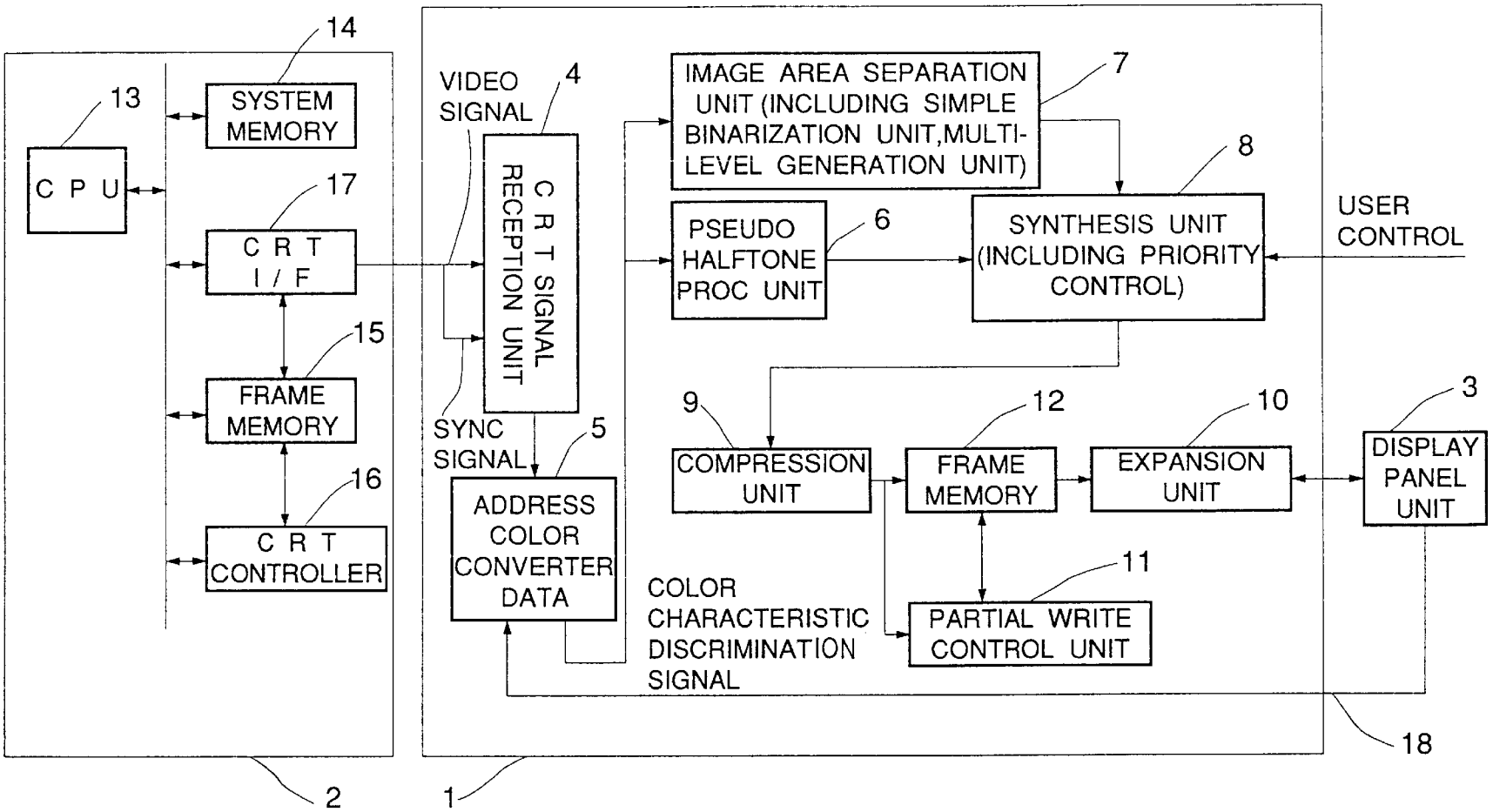
FIG. 1 is a block diagram of an entire display device.
Figure 2:
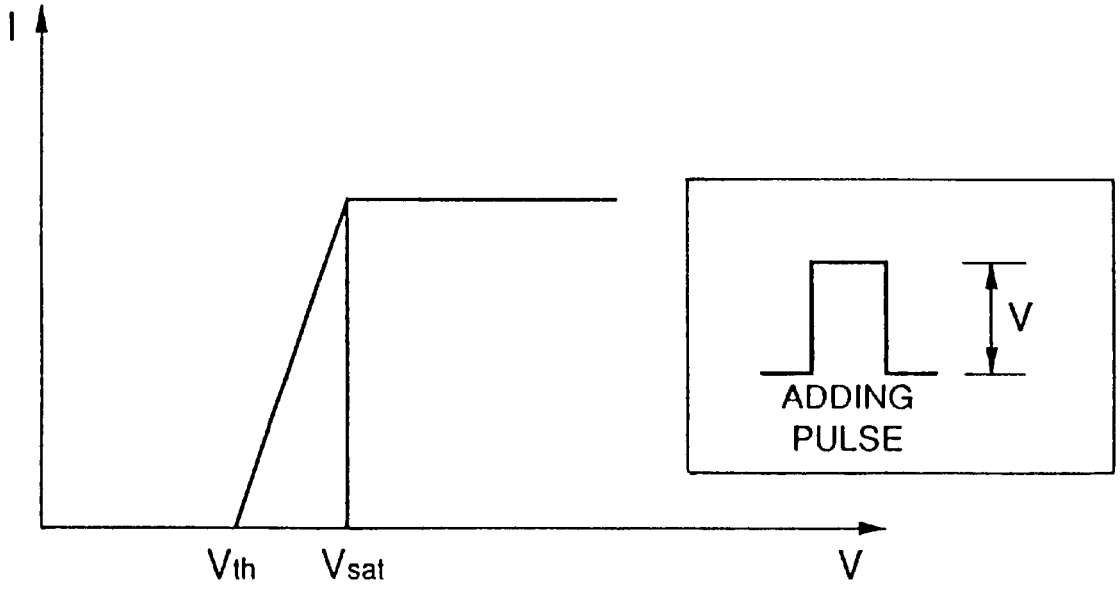
FIG.2 PRIOR ART
FIG. 2 is a graphic representation showing the relationship between the switching pulse amplitude and the transmittance of a ferroelectric liquid crystal element.
Figure 3A:
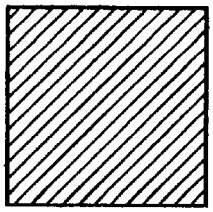
FIG.3A PRIOR ART
FIGS. 3A to 3D are views showing the display states of ferroelectric liquid crystal element.
Figure 3B:
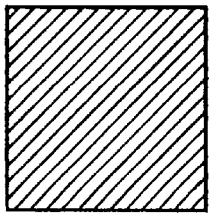
FIG.3B PRIOR ART
Figure 3C:
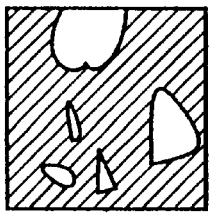
FIG.3C PRIOR ART
Figure 3D:
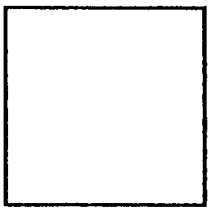
FIG.3D PRIOR ART

FIG. 1 is a block diagram of the entire display device.

In the same figure, 1 is a display control device of an information processing system to which the present invention is applied.

2 is an information supply and image generation source of the information processing system 1, including a computer and a personal computer.

3 is a display panel unit (comprising a ferroelectric liquid crystal as mentioned above), one picture element being constituted of four pixels of R, G, B and I. Also, a color characteristic discrimination signal 18 is output so that the color characteristic determined by the pixel configuration (shape, array) of the panel can be discriminated externally. The display panel unit 3 includes a drive circuit for driving the panel, a control circuit for controlling the panel to be driven in the optimal condition, a panel backlight, a power source and so on.

4 is a CRT signal (display signal) reception unit for receiving a CRT signal (image signal or synchronizing signal) and having a feature of converting it into a signal suitable for a subsequent processing unit. Since the CRT signal of a typical computer is an analog video signal, the reception unit 4 includes an A/D converter and a sampling clock generation unit for the A/D conversion.

5 is a color converter which is a main part of the present invention. By using R, G, B signals which are converted from a CRT signal into digital form, R, G, B and I signals are generated.

6 is a pseudo halftone processing unit for outputting binary or multi-level data, and having a feature of generating a binary or multi-level halftone signal from the image signal converted into digital form by the CRT signal reception unit 4 and color converted by the color converter 5. An example of pseudo halftone display as referred to herein will be shown in the following.

<Error Diffusion Method>

Binarization or multi-level generation errors arising in converting peripheral pixels around a pixel of interest (which are processed before the pixel of interest) into binary or multi-level value are weighted, and then added to the pixel of interest, so that a threshold is determined at which value the binarization or multi-level generation is performed.

<Average Density Reserve Method>

Threshold is not constant, but is determined by a weighted average value obtained from already converted binary or multi-level data around the pixel of interest in the error diffusion method, so that the threshold is variable depending on the state of the pixel.

Besides, a dither method and a density pattern method are provided, including a multi-level dither method at multi level, but not limited to binary level.

7 is an image area separation unit (including a simple binarization or multi-level generation unit) which separates a portion which should be excluded from pseudo halftone display such as characters or fine lines in the image information transmitted via the color converter 5 from the CRT signal reception unit 4. Also, the image area separation unit 7 includes a simple binarization or multi-level generation unit for effecting simple binarization or multi-level generation when not performing the pseudo halftone processing. An example of an image area separation method in this embodiment will be shown below.

<Luminance Discrimination Separation Method>

One example of separating means is a separation method based on the luminance of a CRT image signal. Typically, the characters and fine lines on the computer containing important information on the screen have relatively high luminance. Thus, separation is effected by discriminating the high luminance portion in the CRT signal.

8 is a synthesis unit (including switch priority) for synthesizing the data obtained in the pseudo halftone processing unit 6 and the simple binarization data obtained in the image area separation unit 7. The portion discriminated by the image area separation unit 7 is preferentially subjected to simple binarization. The user of the display system can switch on or off the practice of this priority feature.

9 is a compression unit, and 10 is an expansion unit. The compression unit 9 has a function of compressing the amount of information to reduce the capacity of the frame memory when storing binary data in binary pseudo halftone into the frame memory 12. Also, the expansion unit 10 has a function of restoring compressed data, when reading data from the frame memory 12.

11 is a partial write control unit having a function of, in a display device having a memory such as FLC, detecting only a rewritten portion of the image data in the frame memory, and outputting data of the rewritten portion to the display device preferentially. It can also preferentially paint the rewritten portion by this function, and is effective for an FLC requiring some time to rewrite.

12 is a frame memory for storing image data necessary for the partial rewrite detection.

13 is a CPU for controlling the computer 2.

14 is a CPU system memory for controlling the computer 2 comprised of RAM and ROM.

15 is a frame memory for storing image information generated by the computer 2.

16 is a CRT controller for controlling the frame memory 15 for the CRT signal.

17 is a CRT interface for converting image data from the frame memory 15 into the CRT signal (analog signal).

Referring now to FIG. 1, the operation will be described below.

First, the computer 2, which is an image information source, outputs image information stored in the frame memory 15 via the CRT interface 17 to the CRT under the control of the CRT controller 16 which is controlled by the CPU 13. A CRT signal is subdivided into a video signal (three types of analog signal of R, G, B provided in the color display, one type of analog signal provided in the monochrome display) and a synchronizing signal (signals for delimiting the video signal for each line and each frame, which are referred to as a horizontal synchronizing signal and a vertical synchronizing signal, respectively). The CRT signal is input into the CRT signal reception unit 4, the video signal being converted into digital signals of R, G and B (each consisting of plural bits). The sampling clock at this time is generated by multiplying the horizontal synchronizing signal. A digitized video signal is input into the color converter 5. The color converter 5 generates and outputs R, G, B and I signals from input R, G and B signals. The generated R, G, B and I signals are input into the pseudo halftone processing unit 6, and converted into a binary or multi-level value. Conversion procedure at this time relies on a non-interlace conversion in order to convert a transmitted CRT signal at any time, whereby the halftone reproducibility is enhanced as the pseudo halftone processing can conduct error distribution and the calculation of threshold on principle.

On the other hand a digital signal with I signal added via the color converter 5 from the CRT signal reception unit 4 is input into the image area separation unit 7 at the same time, where a portion of the signal unsuitable for the pseudo halftone such as characters and fine lines is discriminated as previously described in a paragraph of function description and converted into binary form with a single threshold or multi-level form with a fixed threshold, without being subjected to pseudo halftone processing.

The binary or multilevel signals obtained in the pseudo halftone processing unit 6 and the image area separation unit 7 are appropriately switched by the synthesis unit 8 to be output to the compression unit 9. This switching is made to preferentially output the simple binary or multi-level signal obtained in the image area separation unit 7. The priority can be compulsorily changed upon a request from the user of the display system. This processing is effective when displaying characters and fine lines preferentially or when displaying a natural image such as a photograph preferentially.

The compression unit 9 compresses a signal from the synthesis unit 8 and stores it in the frame memory 12. The compression method is preferably a line unit compression method such as MH as the partial write control is for each line.

The signal from the compression unit 9 is transmitted at the same time to the partial write control unit 11. The partial write control unit 11 reads a compressed signal at least one frame before from the frame memory 12, and compares it with the line transmitted from the compression unit 9. The partial write control unit 11 controls the frame memory 12 to detect the line containing the different pixel and outputs its line signal to the expansion unit 10 preferentially.

This embodiment may be configured to exclude the compression unit 9 and the expansion unit 10. In this case, the signal from the synthesis unit 8 is directly written into the frame memory 12, and the signal in the frame memory 12 is directly output to the display panel unit 3 under the control of the partial write control unit.

Figure 4:
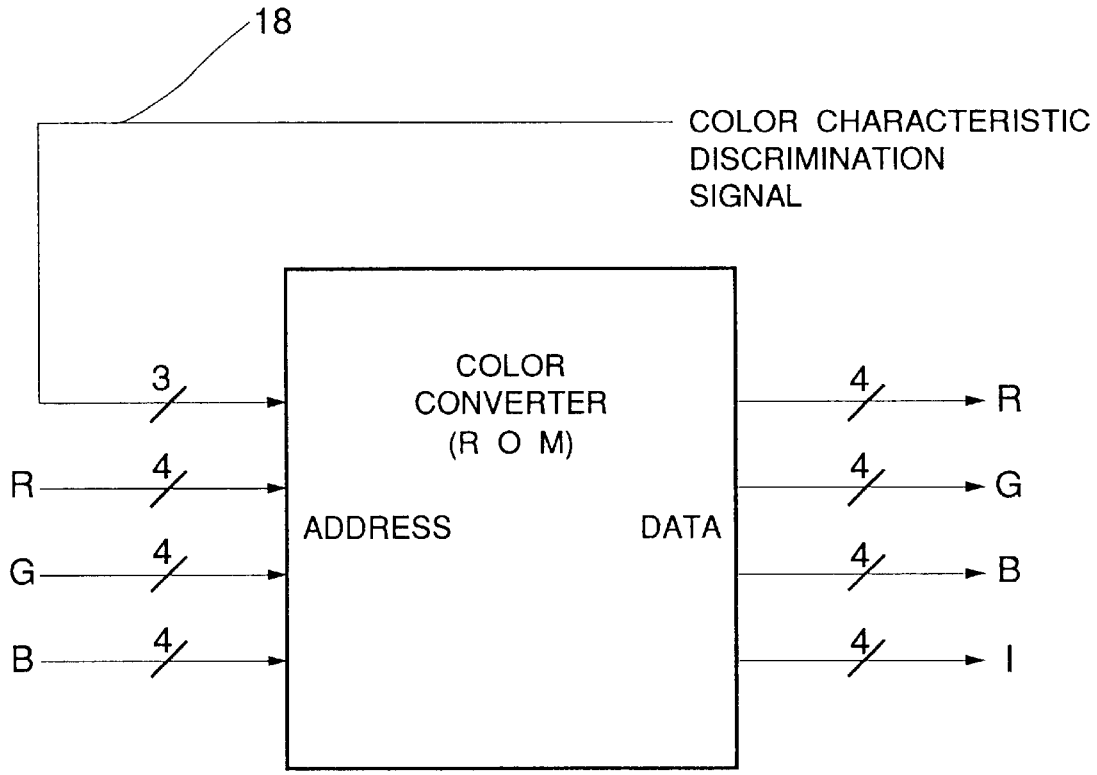
FIG. 4 is a diagram showing a color converter.

The color converter 5 which is a main portion of the present invention will be described below in detail. FIG. 4 is a color converter to which the features of the present invention are applied most appropriately.

The color characteristic discrimination signal 18 is a signal output from the display panel unit 3 in FIG. 1, consisting of three bits in this case. The color characteristic of the display panel unit is obtained theoretically or by measurement, and set at 0 if the color characteristic is $F_0$, or at 1 if it is $f_1$. In the following, the same rule is applied for 2, 3, . . . and with three bits, the panel having up to seven kinds of color characteristics can be dealt with.

The color converter 5 is constituted of a ROM herein. The input (address) into the color converter 5 is R, G, B signals output from the CRT signal reception unit 4, each consisting of four bits, and a color characteristic discrimination signal 18 output from the display panel unit 3, as shown in FIG. 1. And R, G, B and I signals are output as the output data. Each output signal consists of four bits.

The internal data of the color converter 5 (ROM) will be described below. First, where the color characteristic of the display panel unit is $f_0$, look-up data groups for all the groups of input signal (R, G, B) are obtained theoretically or by measurement for the panel display color designated by the input signal group and the signal group (R, G, B, I) which can approximate most closely or optimally the panel display color or desired color among the reproducible colors in the display panel unit. Likewise, for $f_1$ to $f_7$, the look-up data groups are obtained. Obtained data is stored in ROM, and corresponding data is selected by the input R, G, B and the color characteristic discrimination signal 18 is as the address.

With the configuration as described above, R, G, B, I signals can be reproduced from R, G, B signals. Also, even for a display panel unit having different color characteristics, it is possible to deal with the display panel unit by using the color characteristic discrimination signal output from the display panel unit as the data has been already stored in the color converter 17 (ROM). Further, by changing the data in the ROM (or replacing the ROM), the color conversion processing can be made programmable. And by using a ROM having high speed access time with the look-up table method, the color conversion processing can be simply implemented in real time.

While in this embodiment the color converter is constituted of a single ROM, it will be appreciated that the color converter may be constituted of a separate ROM for each look-up data group of the display panel unit having different color characteristics, wherein the ROM is selected by the color characteristic discrimination signal 18.

It will be also appreciated that instead of selecting the ROM, the CPU in the display control unit may discriminate the look-up table group in accordance with the color discrimination signal 18, wherein the data is set in RAM.

Also, the color characteristic discrimination signal only needs to indicate the color characteristic of the display panel, as mentioned above. For example, when the color characteristic of the display panel varies with the temperature, the temperature information may be used as the discrimination signal.

As described above, according to the embodiment of the present invention, I signal can be generated from R, G, B signals, whereby it is possible to exploit the feature of display means containing I signal simply by using the conventional CRT signal without any change. Also, to cope with the change in color characteristic of the display means, the look-up table can be used programmably and in real time.

As described above, according to the present invention, the color conversion processing is allowed in accordance with the color characteristic of the display panel.

It should be noted that the image area separation method is not limited to that of the above embodiment, but may be implemented by utilizing the spatial frequency component.

Also, the color component conversion is not limited to a conversion from RGB into RGBI, but may be effected from RGB to R'G'B', or from YIQ to RGB, for example.

The image processing may be changed depending on the temperature characteristic of the display panel, as well as the color decomposition filter arrangement, the array of display elements or its density.

The present invention is not limited to the above embodiment, but various variations and modifications can be made within the scope of the claims.

What is claimed is:

1. An apparatus, which is connected to supplying means including a CRT interface for supplying color image information representing a color image and display means having an interface different than the CRT interface for forming a color image corresponding to the color image information, for controlling the display means, comprising:

first receiving means for receiving the color image information from the supplying means;

second receiving means for receiving display status information from the display means, with the display status information used for processing the color image information and relating to a color characteristic of the display means;

processing means for performing color image processing on the color image information received by said first receiving means in accordance with the display status information relating to the color characteristic of the display means and received by said second receiving means and generating color image data; and output means for outputting the color image data generated by said processing means to the display means as display data, wherein the display status information received by said second receiving means is sent from the display means to which the display data is output by said output means.

2. An apparatus according to claim 1, wherein the display means has display elements comprising a ferroelectric liquid crystal.

3. An apparatus according to claim 1, wherein the image data is color component data of red, green, blue and white.

4. An apparatus according to claim 1, wherein said processing means comprises a look-up table.

5. An apparatus according to claim 1, wherein said processing means performs color image processing on the image information.

6. An apparatus according to claim 1, wherein said processing means comprises a rewritable memory.

7. An apparatus according to claim 1, wherein the supplying means is part of said apparatus, and said supplying means is a computer.

8. An apparatus according to claim 7, wherein said supplying means includes a central processing unit.

9. An apparatus according to claim 7, wherein said supplying means includes a frame memory.

10. An apparatus according to claim 1, wherein said apparatus comprises a display data supplying system together with a computer including a frame memory.

11. An apparatus according to claim 1, wherein the display status information relates to color reproduction characteristics of the display means.

12. An apparatus according to claim 1, wherein the display status information relates to the temperature of the display means.

13. A method for controlling an apparatus, which is connected to supplying means including a CRT interface for supplying color image information representing a color image and display means having an interface different than the CRT interface for forming a color image corresponding to the color image information, the method comprising the steps of:

receiving the color image information from the supplying means by first receiving means;

receiving display status information from the display means, with the display status information used for processing the color image information and relating to a color characteristic of the display means, by second receiving means;

processing the color image information received by the first receiving means in accordance with the display status information relating to the color characteristic of the display means and received by the second receiving means and generating color image data; and outputting the color image data to the display means as display data, wherein the display status information is received from the display means to which the display data is output.

14. A display apparatus, comprising:

a control apparatus, which is connected to supplying means including a CRT interface for supplying color image information representing a color image, including first receiving means for receiving the color image information from the supplying means, second receiving means for receiving display status information from the display apparatus, with the display status information used for processing the color image information and relating to a color characteristic of the display apparatus, and processing means for performing color image processing on the color image information received by said first receiving means in accordance with the display status information relating to the color characteristic of the display apparatus and received by said second receiving means and generating color image data;

transmitting means for transmitting display status information which is used for processing the color image information and relates to a color characteristic of the display to said control apparatus;

receiving means for receiving the color image information processed with the display status information by said control apparatus; and display means having an interface different than the CRT interface for displaying an image based on the received color image information.

* * * * *

UNITED STATES PATENT AND TRADEMARK OFFICE

CERTIFICATE OF CORRECTION

PATENT NO. : 6,037,921

DATED : March 14, 2000

INVENTOR(S): YUICHI MATSUMOTO, ET AL.

It is certified that error appears in the above-identified patent and that said Letters Patent is hereby corrected as shown below:

COLUMN 6:

Line 12, "$F_0$," should read --$f_0$,--.

Signed and Sealed this

Tenth Day of April, 2001

*Attest:*

Nicholas P. Godici

NICHOLAS P. GODICI

*Attesting Officer*

*Acting Director of the United States Patent and Trademark Office*